United States Patent [19]

Bissot

[11] Patent Number: 4,722,772

[45] Date of Patent: Feb. 2, 1988

[54] PROCESS FOR ELECTROLYSIS OF SULFATE-CONTAINING BRINE

[75] Inventor: Thomas C. Bissot, Newark, Del.

[73] Assignee: E. I. Du Pont de Nemours and Company, Wilmington, Del.

[21] Appl. No.: 695,247

[22] Filed: Jan. 28, 1985

[51] Int. Cl.[4] ..... C25B 1/16; C25B 1/26

[52] U.S. Cl. ..... 204/98; 204/128

[58] Field of Search ..... 204/98, 128

[56] References Cited

U.S. PATENT DOCUMENTS

| | | | |
|---|---|---|---|
| 2,902,418 | 9/1959 | Burns | 204/98 |
| 3,017,245 | 6/1962 | Goodenough | 204/98 |
| 3,970,528 | 7/1976 | Zirngiebl et al. | 204/98 |
| 4,078,978 | 3/1978 | Zirngiebl | 204/98 |
| 4,146,445 | 3/1979 | Cook, Jr. et al. | 204/98 |
| 4,169,023 | 9/1979 | Satz et al. | 204/98 |
| 4,240,883 | 12/1980 | Iijima et al. | 204/98 |
| 4,251,333 | 2/1981 | Suhara et al. | 204/98 |
| 4,276,130 | 6/1981 | Seko et al. | 204/98 |
| 4,323,437 | 4/1982 | Mucenieks | 204/98 |
| 4,357,218 | 11/1982 | Seko | 204/296 |
| 4,410,404 | 10/1983 | Warburton et al. | 204/98 |
| 4,488,949 | 12/1984 | Lee et al. | 204/98 |

FOREIGN PATENT DOCUMENTS

| | | | |
|---|---|---|---|
| 528331 | 7/1956 | Canada | 204/98 |
| 2709728 | 9/1978 | Fed. Rep. of Germany | 204/98 |
| 49-27278 | 7/1974 | Japan | 204/98 |
| 56-33488 | 4/1981 | Japan . | |

OTHER PUBLICATIONS

Yawataya, *Ion Exchange Membranes for Engineers*, Kyoritsu Publishing Co., Ltd., Tokyo (1982), Section 8.7.

*Primary Examiner*—John F. Niebling

*Attorney, Agent, or Firm*—Roger A. Hines

[57] ABSTRACT

In an improved process for the electrolysis of sulfate-containing brine in a membrane cell, the thickness of the membrane, the concentration of sodium sulfate in the brine and the current density through the membrane in the operating cell are controlled to prevent sulfate damage to the membranes.

6 Claims, 1 Drawing Figure

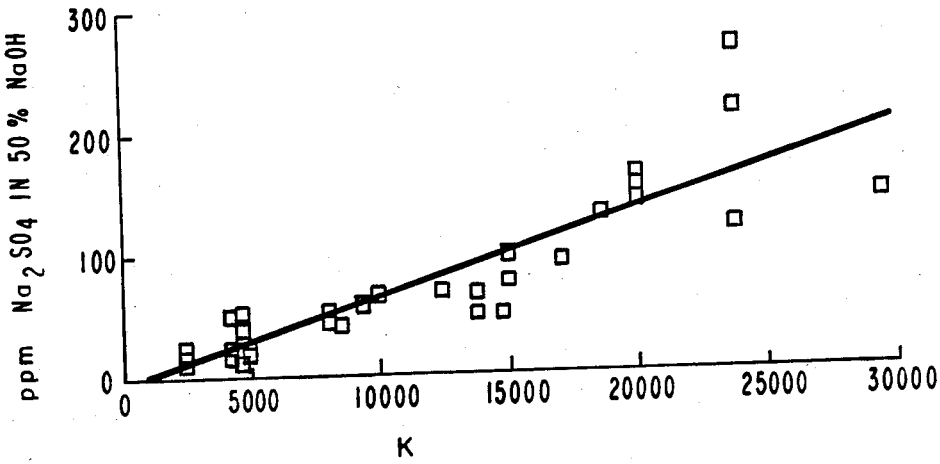
(THICKNESS μm X SODIUM SULFATE CONC. g/l X CURRENT DENSITY kA/$m^2$ )

PROCESS FOR ELECTROLYSIS OF SULFATE-CONTAINING BRINE

BACKGROUND

The use of perfluorinated ion-exchange membranes is rapidly expanding as the preferred energy-efficient technology for the electrolysis of brine to produce caustic and chlorine. Typical electrolytic cells used for this purpose comprise an anode and a cathode, an anode compartment and a cathode compartment, and the perfluorinated ion-exchange membrane situated so as to separate the two compartments. Brine is fed into the anode compartment, and a current is caused to flow through the cell.

It has been found that certain impurities in the brine feed can adversely affect the electrolysis process by reducing the performance and useful life of the ion-exchange membrane. One such common impurity in brine is sodium sulfate. In the cell, sulfate can move through the membrane and precipitate as sodium sulfate in the membrane layer adjacent to the catholyte. To avoid membrane damage caused by sulfate, prior practice has been to limit the concentration of sodium sulfate in the brine feed to a fixed level. For example, J56/33488, assigned to Asahi Glass Co., Ltd., and published Apr. 3, 1981, discloses that it is necessary to keep the concentration of sodium sulfate in the brine below 10 g liter, preferably below 5 g/liter, and ideally below 3 g/liter. This practice is not entirely satisfactory, however, because it does not prevent membrane damage in all circumstances and it often causes the cell operator to go to added expense to remove excess sulfate from the brine.

SUMMARY OF THE INVENTION

A process has now been found for reducing the transport rate of sulfate through ion-exchange membranes when sulfate-containing brine is electrolyzed in a membrane cell. It has been found that the transport rate of sulfate through a membrane increases with the current density through the membrane and also increases with the thickness of the membrane. It has been further found that damage to membranes caused by sulfate can be minimized if the thickness of the membrane (T), the concentration of sodium sulfate in the brine (S) and the current density (CD) in the operating cell are all maintained within certain limits. To be more precise, this new process involves controlling the values of T, S and CD so that T does not exceed about 200 $\mu$m and so that the product of T, S and CD does not exceed about 8000. By using this process, one can avoid sulfate damage to ion-exchange membranes without the necessity of maintaining unrealistically low concentrations of sulfate in the brine fed to the membrane cell.

This process, based as it is on the finding that the transport rate of sulfate increases with both membrane thickness and current density, is surprising in view of known art. For example, J 56/33488, mentioned above, states that alkali metal sulfate is transported through the membrane to the cathode side by diffusion. If this were the case, one would expect sulfate transport to be minimized by increasing the thickness of the membrane, not by decreasing it as has now been found.

Other art which makes the present invention surprising relates to the transport of chloride ions through cation-exchange membranes. U.S. Pat. No. 4,276,130, issued on June 30, 1981, and assigned to Asahi Chemical, indicates that the transport of chloride ions through the membranes can be reduced by using a thicker membrane and higher current density. Yawataya, *Ion Exchange Membranes for Engineers,* Kyoritou Publishing Co., LTd., Tokyo (1982), Section 8.7, also discloses that chloride transport is higher at low current density. These disclosures are, of course, just the opposite of what has now been found regarding sulfate: namely, that its transport rate increases with membrane thickness and current density.

DETAILED DESCRIPTION OF THE INVENTION

For the purpose of this discussion, the product of T, S and CD will be a value labeled K. The relevant equation is as follows:

$$T \times S \times CD = K$$

where

T = the thickness of the membrane in micrometers

S = the concentration of sodium sulfate in the brine feed in grams/liter (g/l)

and

CD = the current density through the membrane in $kA/m^2$.

Tests indicate that, when the variables T, S and CD are controlled so that K does not exceed about 8000, the rate of transport of sulfate through the membrane can be reduced. Since the probability of damage occurring to the membrane from sulfate and the extent of that damage are directly related to the transport rate of sulfate through the membrane, one can, by controlling the value of K as mentioned above, greatly reduce the chance that sulfate will damage the membrane and decrease its efficiency and useful life. In a preferred embodiment, the variables T, S and CD are controlled so that K does not exceed about 5200.

The cation exchange membranes used in this invention are known in the art and are prepared from perfluorinated polymers which have carboxylic acid and/or sulfonic acid functional groups. Perfluorinated polymers having carboxylic acid functional groups and from which cation exchange membranes can be prepared are disclosed in U.S. Pat. Nos. 3,852,326, 3,506,635, 4,267,364, 3,641,104, 4,178,218, 4,116,888, 4,065,366, 4,138,426, British patent Nos. 2,053,902A, 1,518,387 and U.S. Pat. No. 4,487,668. Perfluorinated polymers having sulfonic acid functional groups and from which cation-exchange membranes can be prepared are disclosed in U.S. Pat. Nos. 3,718,627, 3,282,875 and British patent No. 2,053,902A. In addition to preparing membranes from separate films of the above-identified polymers, it is possible to use a laminar film of two or more layers in making the membrane. The membrane may be unreinforced, but for dimensional stability and greater notched tear resistance, membranes are commonly reinforced with a material such as polytetrafluoroethylene or a copolymer of tetrafluoroethylene with perfluoro(propyl vinyl ether). The membranes may also be modified on either or both surfaces so as to have enhanced gas release properties, for example, by providing optimum surface roughness or, preferably, by providing thereon a gasand liquid-permeable porous non-electrode layer. Examples of suitable cation-exchange membranes are those sold as Nafion ® perfluorinated membranes by E. I. du Pont de Nemours and Company.

The variable T, the thickness of the membrane film, is by convention the thickness of the film in the melt processible state, i.e., before the carboxyl and sulfonyl side chains are hydrolyzed to the sodium or potassium salt form. If the membrane surface is to be modified, e.g., by roughening or by coating, T must be measured prior to such modification.

For fabric-reinforced membranes, corrections must be made to T and CD to correct for the thickness contributed by the fabric and the increase in actual current density caused by the shadowing of a portion of the membrane area by the fabric. To make this correction, the following calculations are performed:

Let a=decimal fraction open area of fabric and t=fabric thickness $$T\ \text{corrected} = \text{Film Thickness} + t\,(1-a)$$

$$CD\ \text{corrected} = CD\ \text{measured} \div a$$

The open area of fabric, a, can be measured in a number of ways. It is possible to make actual measurements and calculations from a magnified picture of the membrane. Alternatively, one can measure the light transmission through a membrane and calculate a by comparison with light transmission through a sample without fabric reinforcement.

Fabric thickness, t, is preferably measured on the fabric before the fabric is laminated with the polymer membrane. Alternatively, one can cut the membrane and microscopically measure the fabric thickness at the crossover point of two yarns. To gain the advantages of this invention, namely the ability to electrolyze brine solutions with high sulfate content, it is preferred to utilize relatively thin membranes, i.e., membranes for which T is in the range of about 50 to 200 μm, preferably about 75 to 150 μm.

The concentration of sulfate ion in the brine feed, S, can vary from negligible amounts (e.g. less than 1 gram/liter) to as high as 50 grams/liter. Since the advantage of this invention is that it enables one to use brine with a high sulfate content, it is preferred that the sulfate content be at least about 10 g/l to 15 g/l.

The current density, CD, of a membrane is expressed in $kA/m^2$ of membrane active area. It is desirable, for reasons of economy, to operate a cell at the highest current density possible. Usually, this is in the range of about 1 to 6 $kA/m^2$. In order to electrolyze brine solutions with high sulfate content, it is preferred that the CD be in the range of about 1 to 3 $kA/m^2$.

It has been observed that the concentration of the brine has relatively little effect on sulfate transport compared with the effects of membrane thickness, sulfate concentration and current density. Thus, the process of this invention can be operated within a broad range of exit brine concentrations, e.g., about 100 to 220 g/l. For practical purposes, exit brine concentration will generally be within the range of 170–210 g/l.

The effect of caustic concentration on sulfate transport also appears to be minor in comparison with the factors cited above. Thus, the process of this invention is operable within a broad range of caustic concentrations, e.g., about 20–42% caustic. Sulfate transport does not appear to be much of a problem at caustic concentrations below 20%. Typical caustic concentrations in commercial operations are about 32–35%.

The process of this invention can be further illustrated by the following examples. The following abbreviations are used in the examples:

TFE=tetrafluoroethylene

PSEPVE=perfluoro(3,6-dioxa-4-methyl-7-octenesulfonyl fluoride)

EVE=methyl perfluoro(4,7-dioxa-5-methyl-8-nonanoate)

EW=equivalent weight

EXAMPLES 1–11 AND COMPARATIVE EXAMPLES A–T

A series of five bilayer membranes varying in total film thickness from 80 μm to 240 μm was prepared. The laminates contained as a major component a layer of copolymer of TFE and PSEPVE of 1080 EW and as a minor component a layer of TFE and EVE of 1050 EW. A coating of $ZrO_2$ particles and a functional binder as taught in U.S. Pat. No. 4,437,951 was applied to the TFE/EVE layer which is the cathode side of the membrane. The three membranes can be identified as follows:

Membrane A is a bilayer membrane of 38 μm TFE/EVE copolymer and 102 μm TFE/PSEPVE copolymer Membrane B is a bilayer membrane of 20 μm TFE/EVEcopolymer and 60 μm TFE/PSEPVE copolymer Membrane C is a bilayer, membrane of 50 μm TFE/EVEcopolymer and 100 μm TFE/PSEPVE copolymer Membrane D is a bilayer membrane of 38 μm TFE/EVE copolymer and 202 μm TFE/PSEPVE copolymer Membrane E is a bilayer membrane of 25 μm TFE/EVE copolymer and 175 μm TFE/PSEPVE copolymer These membranes were tested in laboratory chloralkali cells having an active area of 45 $cm^2$ with low-calcium-ion exchanged brine to which sodium sulfate was added to levels of 10 and 20 g/l. The test cells were operated at three current density levels of 3.1, 5.0 and 6.2 $KA/m^2$. The experiments were run at 90° C., 32% caustic and 200 g/l sodium chloride in the anolyte.

The amount of sulfate ion going through the membrane was determined by analyzing the caustic produced by ion chromatography. Results were converted to ppm $Na_2SO_4$ based on 50% caustic and are presented in Table I and plotted in the figure accompanying this application.

TABLE I

| Example | Membrane | T (μm) | S (g/l) | CD ($kA/m^2$) | K | ppm $SO_4$ |
|---|---|---|---|---|---|---|
| 1 | B | 80 | 10 | 3.1 | 2500 | 24 |
| 2 | B | 80 | 10 | 3.1 | 2500 | 12 |
| 3 | B | 80 | 10 | 3.1 | 2500 | 17 |
| 4 | A | 140 | 10 | 3.1 | 4300 | 50 |
| 5 | A | 140 | 10 | 3.1 | 4300 | 24 |
| 6 | A | 140 | 10 | 3.1 | 4300 | 20 |
| 7 | A | 140 | 10 | 3.1 | 4300 | 17 |
| 8 | C | 150 | 10 | 3.1 | 4700 | 53 |
| 9 | C | 150 | 10 | 3.1 | 4700 | 39 |
| 10 | C | 150 | 10 | 3.1 | 4700 | 12 |
| 11 | B | 80 | 20 | 3.1 | 5000 | 19 |
| A | B | 80 | 20 | 5.0 | 8100 | 43 |
| B | B | 80 | 20 | 5.0 | 8100 | 53 |
| C | A | 140 | 20 | 3.1 | 8700 | 41 |
| D | C | 150 | 20 | 3.1 | 9400 | 58 |
| E | B | 80 | 20 | 6.2 | 10000 | 64 |
| F | E | 200 | 20 | 3.1 | 13000 | 67 |

TABLE I-continued

| Example | Membrane | T (μm) | S (g/l) | CD (kA/m²) | K | ppm $SO_4$ |
|---|---|---|---|---|---|---|
| G | A | 140 | 20 | 5.0 | 14000 | 65 |
| H | A | 140 | 20 | 5.0 | 14000 | 49 |
| I | C | 150 | 20 | 5.0 | 15000 | 77 |
| J | C | 150 | 20 | 5.0 | 15000 | 97 |
| K | D | 240 | 20 | 3.1 | 15000 | 49 |
| L | A | 140 | 20 | 6.2 | 17000 | 92 |
| M | C | 150 | 20 | 6.2 | 19000 | 131 |
| N | E | 200 | 20 | 5.0 | 20000 | 163 |
| O | E | 200 | 20 | 5.0 | 20000 | 141 |
| P | E | 200 | 20 | 5.0 | 20000 | 151 |
| Q | D | 240 | 20 | 5.0 | 24000 | 214 |
| R | D | 240 | 20 | 5.0 | 24000 | 264 |
| S | D | 240 | 20 | 5.0 | 24000 | 119 |
| T | D | 240 | 20 | 6.2 | 30000 | 144 |

Inspection of the data in Table I and plotted in the figure shows the expected correlation that average values of sulfate transported through the membrane were greater the higher the concentration of sodium sulfate in the anolyte. Two other correlations from these data, however, were completely unexpected. One is that sulfate transport increased with current density, and the second is that sulfate transport increased with the total thickness of the membrane.

In Example 12 and Comparative Examples U and V, the membrane used was a laminate of TFE/PSEPVE (EW=1100, thickness 150 μm) and TFE/EVE (EW=1080, thickness 50 μm) reinforced with a fabric woven of a copolymer of TFE with perfluoro-(propyl vinyl ether). For these membranes, the film thickness is 200 μm, the fabric thickness (t) is 200 μm and the open area (a) is 0.68, leading to a corrected T value of 264.

EXAMPLE 12

The membranes were operated in laboratory test cells at 3.1 kA/m² CD with a brine feed containing 5 g/l $Na_2SO_4$. Thus K=6100. The average decay rate for four cell tests operated for 100+ days was 0.008% CE/day. This would extrapolate to a current efficiency decline of 5.8% over a two-year period. This is an acceptable rate of decline representing an average performance of about 92–93% over the expected two-year lifetime of the membrane.

Comparative Example U

The test in Example 12 was repeated except that the brine feed contained 33 g/l $Na_2SO_4$. Thus K=40,000. Duplicate cell tests declined from 95% to 93% current efficiency (CE) in 24 days compared to 94.6% for a control (no sulfate). This is a current efficiency decline of 0.066% CE/day attributable to sulfate damage and indicates an unacceptable rate of performance decline since this would extrapolate to a 48% decrease in two years.

At the end of the experiment, the membranes were examined microscopically and found to have significant damage to the cathode surface of the type characteristic of sulfate damage.

Comparative Example V

The test in Example 12 was again repeated except that the brine feed contained 10 g/l sodium sulfate. Thus K=12200. Tests were conducted for 26–40 days. Average current efficiency decline versus controls was 0.020% CE/day. This extrapolates to a 14.6% decline in current efficiency over a two year period which, while an improvement over Comparative Example U, is still considered unacceptable.

Examination of these used membranes also showed characteristic sulfate type damage. The presence of a sulfate-containing precipitate was also verified by scanning electron microscope - X-ray fluorescence spectroscopy and electron spectroscopy for chemical analysis of unwashed samples.

EXAMPLE 13

In this experiment, the membrane used was similar to that described above as membrane A except that it was coated on the cathode side with $ZrO_2$ particles and a functional binder as taught in U.S. Pat. No. 4,437,951. The membrane was operated in a test cell at 3.1 kA/m² with a feed brine containing 10 g/l $Na_2SO_4$. Thus, K=4340. In a 121-day test, the current efficiency/decline averaged 0.003% CE/day. This extrapolates to only 2.2% CE decline in two years. Examination of the used membrane showed no evidence of sulfate precipitation damage.

In Examples 14 and 15, the membrane used was a bilayer membrane of TFE/PSEPVE (EW=1080, thickness 100 μm) and TFE/EVE (EW=1050, thickness 25 μm) reinforced with a fabric woven of polytetrafluoroethylene and coated on the cathode side with $ZrO_2$ particles and a functional binder as taught in U.S. Pat. No. 4,437,951. For this membrane, the film thickness is 125 μm, the fabric thickness is 75 μm and the open area is 0.82, leading to a corrected T value of 138.5.

EXAMPLE 14

The membranes were operated in laboratory test cells for 200 days at 3.1 kA/m² current density with a feed brine containing 10 g/l $Na_2SO_4$. Thus K is 5200. The average current efficiency decline over this period was 0.5% compared to controls which had negligible amounts of sodium sulfate in the brine feed. This represents a decline of 0.0025% CE/day or a total of 1.8% CE in two years. Examination of the used membrane from this test showed no evidence of sulfate precipitation damage.

EXAMPLE 15

The test in Example 14 was repeated except the brine feed contained 15 g/l $Na_2SO_4$. Thus K=7900. After 109 days of testing, the performance was indistinguishable from controls containing no added sulfate to the brine feed, that is a decline of 0.12% CE/day was observed. This extrapolates to an average performance of 92% CE over a two year period.

What is claimed is:

1. In an improved process for the electrolysis of sulfate-containing brine in an electrolytic cell, said cell comprising a perfluorinated cation-exchange membrane having a thickness in the range of 50 to 200 μm situated so as to separate anode and cathode compartment, the improvement comprising controlling the thickness of the cation-exchange membrane, T, the concentration of sodium sulfate in the range of 10 to 50 g/l, in the brine feed, S, and the current density through the membrane, CD, so that the product of T, S and CD, where T is expressed in μm, S is expressed in g/l, and CD is expressed in kA/m2, does not exceed 8000.

2. The process of claim 1 wherein the product of T, S and CD does not exceed about 5200.

3. The process of claim 2 wherein S is in the range of about 10 to 15 g/l.

4. The process of claim 2 wherein T is in the range of about 75 to 150 μm.

5. The process of claim 2 wherein CD is in the range of about 1 to 3 $kA/m^2$.

6. The process of claim 2 wherein S is in the range of about 10 to 15 g/l, T is in the range of about 75 to 150 μm, and CD is in the range of about 1 to 3 $kA/m^2$.

* * * * *